US010178894B2

(12) United States Patent
Vandenbussche

(10) Patent No.: US 10,178,894 B2
(45) Date of Patent: Jan. 15, 2019

(54) TANGLESS BUCKLE

(71) Applicant: Fitbit, Inc., San Francisco, CA (US)

(72) Inventor: Gregoire Ludovic Vincent Vandenbussche, San Francisco, CA (US)

(73) Assignee: Fitbit, Inc., San Francisco, CA (US)

( * ) Notice: Subject to any disclaimer, the term of this patent is extended or adjusted under 35 U.S.C. 154(b) by 0 days.

(21) Appl. No.: 15/722,907

(22) Filed: Oct. 2, 2017

(65) Prior Publication Data

US 2018/0092438 A1 Apr. 5, 2018

Related U.S. Application Data

(60) Provisional application No. 62/403,007, filed on Sep. 30, 2016.

(51) Int. Cl.

| | |
|---|---|
| ***A44B 11/24*** | (2006.01) |
| ***A44C 5/00*** | (2006.01) |
| ***A44C 5/20*** | (2006.01) |
| ***A44B 11/22*** | (2006.01) |

(52) U.S. Cl.

CPC ..... *A44B 11/24* (2013.01); *A44B 11/22* (2013.01); *A44C 5/0053* (2013.01); *A44C 5/20* (2013.01); *A44C 5/2071* (2013.01); *A44D 2203/00* (2013.01)

(58) Field of Classification Search

CPC ..... A44B 11/24; A44C 5/0053; A44C 5/20; A44D 2203/00

See application file for complete search history.

(56) References Cited

U.S. PATENT DOCUMENTS

| | | | | | |
|---|---|---|---|---|---|
| 2,443,805 | A | * | 6/1948 | Segal | A44B 11/24 24/188 |
| 3,561,153 | A | * | 2/1971 | Harper | A63H 33/3066 359/806 |
| 4,307,459 | A | * | 12/1981 | Iwao | G04B 45/003 368/45 |
| D735,190 | S | * | 7/2015 | Song | D11/87 |
| D737,699 | S | * | 9/2015 | Chang | D10/39 |
| D766,758 | S | * | 9/2016 | Park | D10/70 |
| D773,052 | S | * | 11/2016 | Wimmer, IV | D10/103 |
| 2013/0219960 | A1 | * | 8/2013 | Gerard-Goddet | A44C 5/0053 63/3.2 |

(Continued)

OTHER PUBLICATIONS

Physical exhibit of Sony SmartBand 2, as purchased Sep. 1, 2016, 1 page with physical exhibit attached.

*Primary Examiner* — Robert Sandy
*Assistant Examiner* — David M Upchurch
(74) *Attorney, Agent, or Firm* — Weaver Austin Villeneuve & Sampson LLP

(57) ABSTRACT

A tangless buckle system for straps for watches, fitness monitors, and other limb-worn devices. In such tangless buckle systems, a buckle with a tooth is provided. In contrast to a traditional buckle, the tooth and the buckle are fixed with respect to one another, i.e., the tooth does not rotate relative to the buckle. As this new buckle design does not include the rotating tang that extends all the way across the buckle loop in a traditional buckle design, the new design may be referred to as a "tangless" buckle. Such buckles may provide a simpler, yet highly secure, mechanism for securing such devices.

19 Claims, 16 Drawing Sheets

(56) References Cited

U.S. PATENT DOCUMENTS

| | | | | |
|---|---|---|---|---|
| 2013/0283501 | A1* | 10/2013 | Moritz | A41F 9/002 2/321 |
| 2014/0075723 | A1* | 3/2014 | Iten | A44B 11/226 24/193 |
| 2014/0259545 | A1* | 9/2014 | King | A44B 11/006 24/170 |

* cited by examiner

TANGLESS BUCKLE

CROSS-REFERENCE TO RELATED APPLICATION

This application claims benefit of priority under 35 U.S.C. § 119(e) to U.S. Provisional Patent Application No. 62/403,007 filed Sep. 30, 2016, and titled "TANGLESS BUCKLE," which is hereby incorporated by reference herein in its entirety.

BACKGROUND

Wearable fitness monitors and trackers are commonly implemented in a wristband-type form factor so that they may be worn as a watch. Such wearable fitness monitors commonly have a fitness monitor or tracker body to which wrist straps (also referred to herein as wrist band portions or strap portions) are attached. Such straps may be fastened to one another, for example, using a standard buckle-and-tang clasp, a snap-clasp, or other fastening system. In most such scenarios, one strap portion, which is referred to as the "buckle" portion or strap herein (even if it uses a fastening mechanism other than a buckle), has a mechanism attached to one end, and the other strap portion, which may be referred to as the "adjustment" portion or strap, has features that allow the adjustment portion or strap to be variably located relative to the buckle portion or strap and then secured relative to the buckle portion or strap by the fastening mechanism.

A snap-clasp, such as the snap-clasps used in the Nike+ SportBand™, fastening system, includes an adjustment portion or strap that has a series of through-holes in it, and a buckle portion or strap that has one or more posts protruding from it that may snap into one or more of the holes on the adjustment portion or strap. Such clasps are attractive from a manufacturing perspective, as only one separate piece (a peg component with the post or posts) must be made, although the adjustment portion or strap will frequently require reinforcement with a spine of stronger material than the material from which the rest of the adjustment portion is made—this is because the soft elastomeric materials commonly used for wristbands may not be rugged enough to withstand repeated insertion/removal of the posts, and may also not be strong enough to retain the posts if the wristband snags on an object. The snap-clasp has a low profile since the peg component may be flush with the exterior surface of the buckle portion or strap, which reduces the chances of a snap-clasp band scratching or catching on objects. Snap clasps, however, may be difficult to fasten snugly onto a person's wrist since the person must frequently squeeze the end of the buckle portion or strap with the posts, as well as the portion of the adjustment portion or strap having the holes into which the posts are being inserted, in between two fingers in order to push the posts into the holes. This means that the wristband is sized to accommodate the person's wrist+one finger, and once the finger is removed, the wristband may be loose, which can interfere with heart rate measurement (which commonly requires good skin-to-device contact). Snap-clasps may also, despite the reduced chance of them snagging on objects, catch on edges or other obstacles, causing them to unfasten—if this is not noticed by the wearer, it can result in the unit being lost.

Buckle-and-tang clasps, which are frequently used in watches, feature a buckle, a tang, a pivot bar, and a keeper, in addition to the buckle strap and the adjustment strap. The buckle and the tang are both affixed to the buckle strap by way of the pivot bar, allowing both components to rotate freely with respect to one another and the buckle strap. The tang is long enough that it cannot rotate past the buckle, and, during use, is threaded through holes in the adjustment portion or strap, thereby preventing the adjustment portion or strap from being pulled through the buckle. Buckle-and-tang clasps are extremely secure, but are more expensive to manufacture than snap-clasps due to the increased part count and assembly complexity of the buckle-and-tang assembly.

Discussed herein is a new fastener system for watches, fitness trackers, and other devices that may be worn on a person's limbs.

SUMMARY

Details of one or more implementations of the subject matter described in this specification are set forth in the accompanying drawings and the description below. Other features, aspects, and advantages will become apparent from the description, the drawings, and the claims.

BRIEF DESCRIPTION OF THE DRAWINGS

The various implementations disclosed herein are illustrated by way of example, and not by way of limitation, in the figures of the accompanying drawings, in which like reference numerals refer to similar elements.

FIGS. 1 through 24 are to-scale within each drawing, although the scale from drawing to drawing may differ. The above-listed figures are merely illustrative in nature, and it is to be understood that the concepts discussed and described herein in relation to these Figures may encompass other implementations that do not correspond directly with the depicted examples but which nonetheless fall within the overall scope of this disclosure. Similar or analogous components in different implementations may be referred to throughout using reference numbers sharing the same last two digits; if a numbered element in a figure is not otherwise described in the specification with reference to a particular drawing, the description of a similar element sharing the same last two digits in another drawing is equally applicable to the element that is not otherwise described, as appropriate.

DETAILED DESCRIPTION

The present inventor conceived of a new type of buckle system that may offer numerous advantages over existing buckle designs. In this new buckle design, instead of a movable buckle with an independently movable tang, a buckle with a tooth is provided. In contrast to a traditional buckle, the tooth and the buckle are fixed with respect to one another, i.e., the tooth does not rotate relative to the buckle. A further distinction is that the tooth does not extend all the way across the buckle, i.e., it is a cantilevered structure that extends from a base portion of the buckle but does not extend all the way across the loop portion of the buckle. As this new buckle design does not include the rotating tang that extends all the way across the buckle loop in a traditional buckle design, the new design may be referred to as a "tangless" buckle.

Due to the fact that the tooth and the buckle are fixed relative to one another, tangless buckles may be manufactured as a single, contiguous part, e.g., injection or die cast, lowering manufacturing and assembly costs. Furthermore, tangless buckles may provide for more granulated band tightness adjustment than in traditional buckle designs. In a traditional buckle design (or a snap-clasp design), the holes in the adjustment portion or strap must pass all the way through the strap so that the posts or tang may pierce the adjustment portion or strap. As a result, the holes must typically be spaced a minimum distance apart to ensure that the adjustment portion is not over-weak or prone to failure—this limits the amount of adjustment granularity that may be provided by such straps. In a tangless buckle, however, the openings in the adjustment portion or strap may be blind holes, i.e., they do not need to pass completely through the adjustment portion or strap, leaving the exterior surface of the adjustment strap or portion potentially intact and free of any openings or apertures. This unbroken exterior surface may be more cosmetically appealing as it is uninterrupted by unsightly holes and also stronger, as there is more uniform distribution of loads through the adjustment strap or portion. Tangless buckles may also be easily fastened using only one hand, which may be more convenient than with traditional buckle designs.

Figure 1:
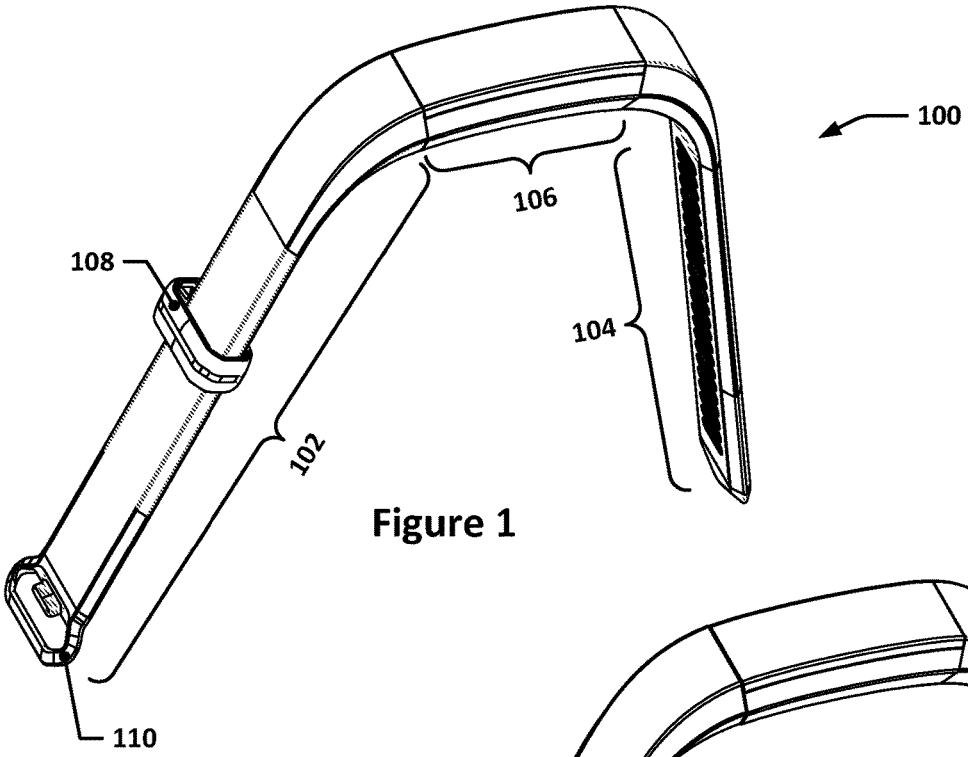
FIG. 1 depicts a three-dimensional view of an example wearable fitness tracker featuring a tangless buckle.

FIG. 1 depicts a three-dimensional view of an example wearable fitness tracker featuring a tangless buckle. In FIG. 1, the wearable fitness tracker 100 includes a tracker or fitness monitor unit (which could also simply be a watch or other wrist-wearable device) 106 that is connected with a buckle strap or portion 102 and an adjustment strap or portion 104. The wearable fitness tracker 100 also includes a keeper 108 and a tangless buckle 110, which may also be referred to hereinafter as simply a "buckle."

Figure 2:
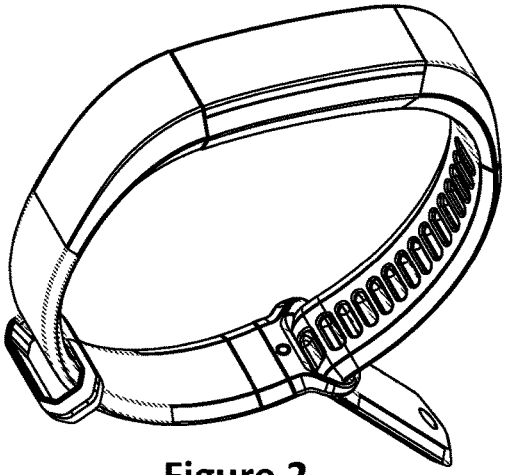
FIG. 2 depicts the example wearable fitness tracker of FIG. 1 with the strap partially fastened.
Figure 3:
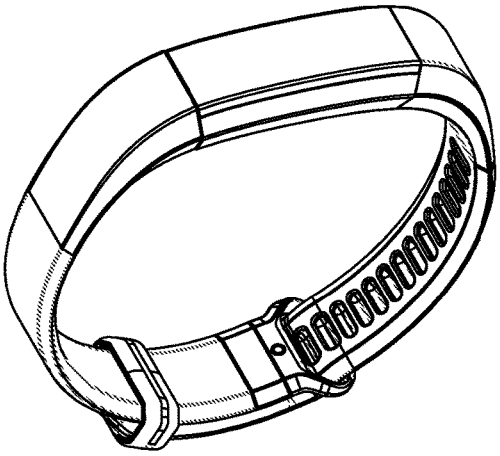
FIG. 3 depicts the example wearable fitness tracker of FIG. 1 with the strap fully fastened.

FIG. 2 depicts the example wearable fitness tracker of FIG. 1 with the strap partially fastened. FIG. 3 depicts the example wearable fitness tracker of FIG. 1 with the strap fully fastened.

Figure 4:
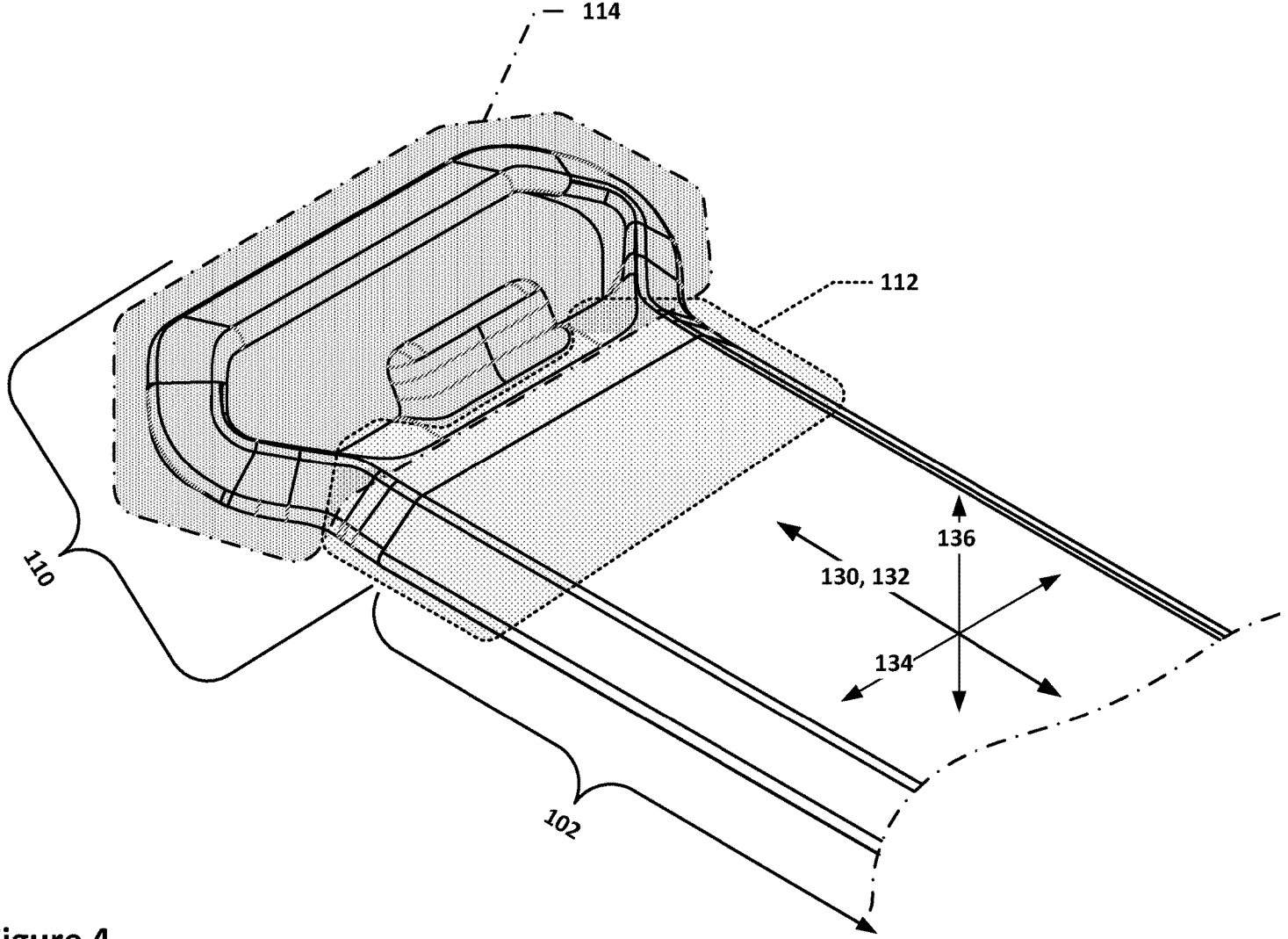
FIGS. 4 and 5 depict detail views of the example tangless buckle of the example wearable fitness tracker of FIG. 1.
Figure 5:
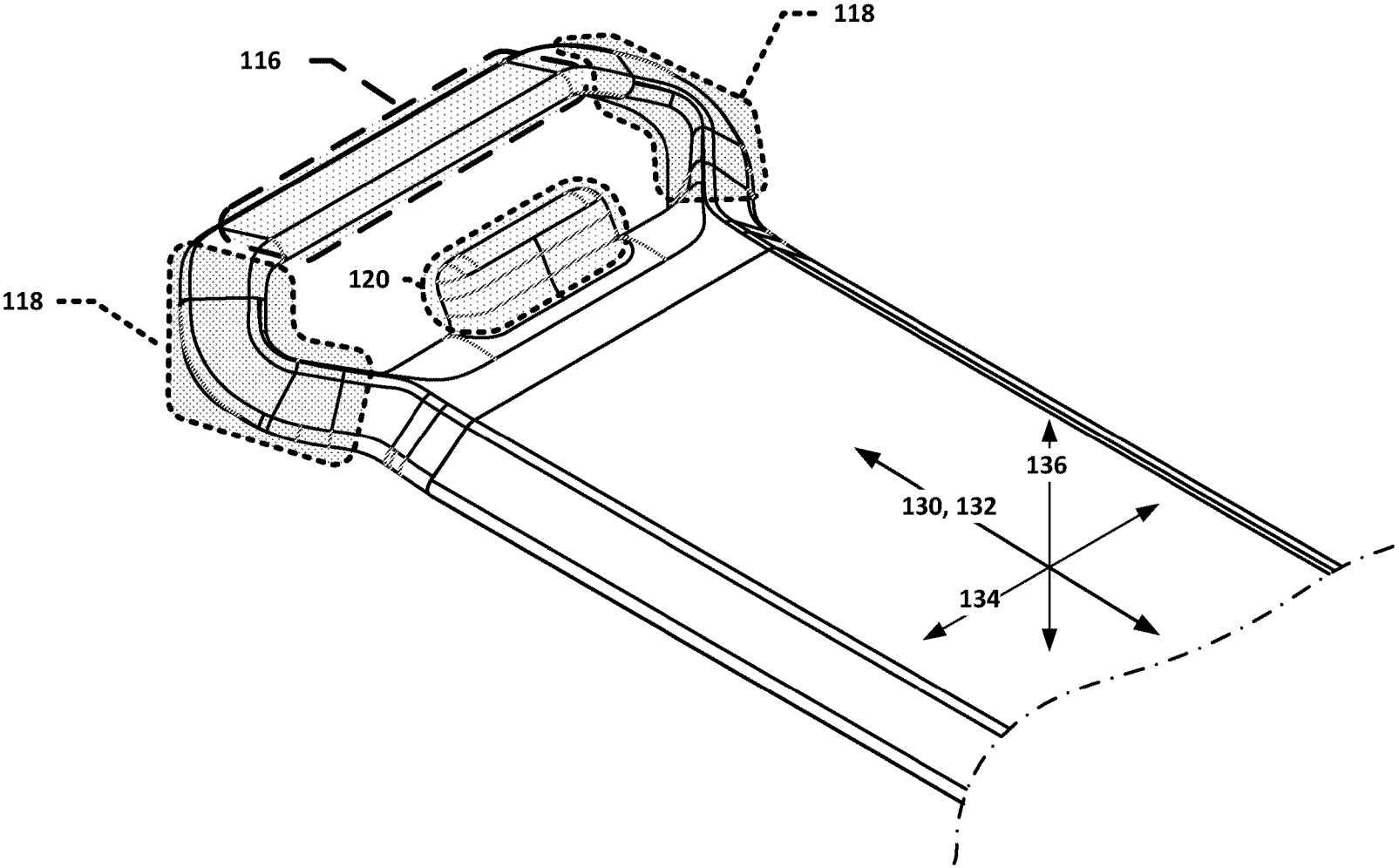

FIGS. 4 and 5 depict detail views of the example tangless buckle of the example wearable fitness tracker of FIG. 1. The tangless buckle 110 may include two general regions or portions—a loop portion 114 and a base portion 112. The base portion 112 may transition to the loop portion 114, so the two portions may coexist to some extent. The loop portion 114 may be generally thought of as a structure that encircles the adjustment portion (shown later) when the straps are fastened, whereas the base portion 112 may generally be thought of as the structure that joins the loop portion 114 to the buckle strap or portion 102. The buckle portion or strap 102 may generally be regarded as having a longitudinal center axis 130 that extends in a first direction 132 along the length of the buckle strap or portion 102. The adjustment strap or portion 104 may have a similar longitudinal center axis, although defined with respect to the adjustment strap or portion 104. It is to be understood that since the buckle strap or portion 102 is flexible and may be curled into a wristband configuration, the longitudinal center axis 130 may vary with location along the length of the buckle strap or portion 102. For the purposes of the discussion herein, relationships referring to the longitudinal center axis 130 and the first direction 132 refer to the longitudinal center axis 130 and first direction 132 as evaluated at the end of the buckle portion or strap 102 where it joins the base portion 112. The buckle portion or strap 102 may also have a width in a second direction 134 and a thickness in a third direction 136, which may be both perpendicular to each other and to the first direction 132 (again, evaluated at the end of the buckle portion or strap 102 for the purposes of these discussions). The adjustment portion or strap 104 may also have a corresponding width and thickness. In most cases, but not all, the thickness and widths of the adjustment portion or strap 104 and the buckle portion or strap 102 may be the same.

As can be seen in FIG. 5, the loop portion 114 may include a transverse segment 116 that extends in a direction generally parallel to the second direction 134 and that is joined to the base portion 112 by opposing side segments 118. In the depicted example, the side segments 118 are angled such that the opening passing through the center of the loop portion 114 is hexagonal in shape, but other implementations may feature straight side segments 118, resulting in a rectangular opening passing through the center of the loop portion 114, or other shapes resulting in other opening shapes. A tooth 120 may extend out from the base portion 112 towards the transverse segment 116; as can be seen, the tooth 120 does not extend all the way to the transverse segment 116.

Figure 6:
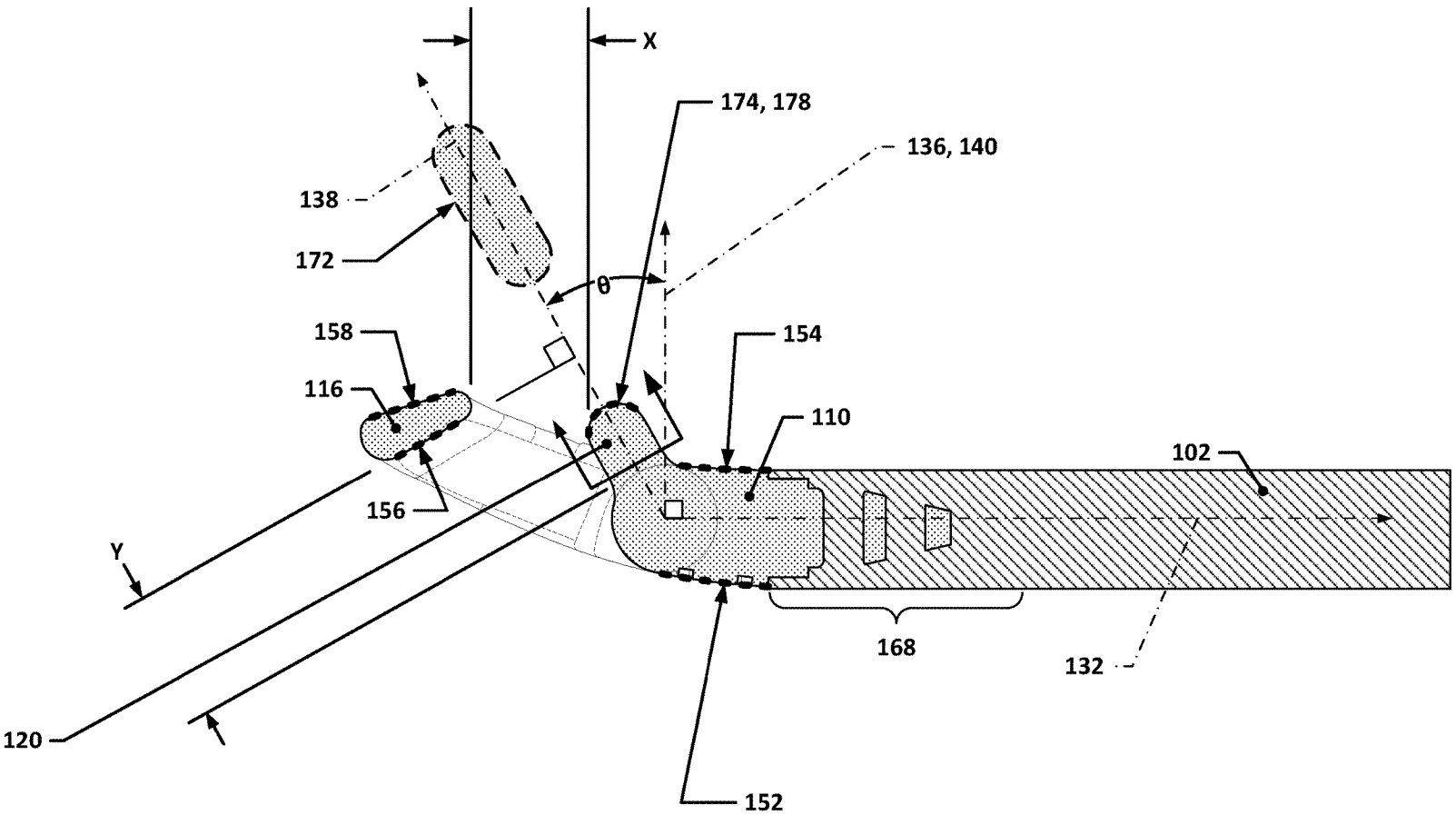
FIG. 6 depicts a side section view of the example tangless buckle of the wearable fitness tracker of FIG. 1.

FIG. 6 depicts a side section view of the example tangless buckle of the wearable fitness tracker of FIG. 1. As can be seen, the tangless buckle 110 may be embedded within a first end 168 of the buckle portion or strap 102, which may be an injection-molded polyurethane or other elastomeric material. To that end, the end of the tangless buckle 110 that is embedded within the strap material may be thinner than the non-embedded part of the base portion 112, thereby forming a "tongue" of buckle material, and may have a multitude of holes through it so that the strap material may flow through the holes during molding, thereby forming a plurality of continuous isthmuses of strap material through the tangless buckle 110 and securing the tangless buckle 110 to the buckle portion or strap 102. Alternatively, the tangless buckle 110 may be sewn into a leather or textile strap, or otherwise attached to the buckle portion or strap 102 such that the tangless buckle 110 does not rotate relative to the buckle portion or strap 102 (or at least does not really rotate relative to the first end 168 of the buckle portion or strap 102 to which the tangless buckle 110 is attached). In such a case, the tangless buckle 110 may have a tongue of material similar to that used in the injection-molded variant, except that there may be a plurality of smaller-diameter holes, e.g., sized to allow a sewing needle and thread to pass through, along the side edges of the tongue to allow the tangless buckle 110 to be sewn into such a strap.

A number of other characteristics of the example tangless buckle are illustrated in FIG. 6. For example, the tooth 120 may extend away from the base portion 112 along a tooth axis 138, which may form an angle between the third direction 136, i.e., an axis 140 perpendicular to the first direction 132. The tooth 120 may have a cross-section 172 (in this case, a generally rectangular cross-section, although one that has rounded corners so as to have an obround shape). In some implementations, the tooth 120 may extend along a non-linear tooth axis 138, e.g., an arced path; in such implementations, the tooth axis may be viewed as any of the linear axes that are tangent or parallel to the arced path (or other path along which the tooth 120 extends). While the tooth 120 may be any of a variety of lengths, the longer the tooth 120 is, generally the more secure the fastened connection will be. Teeth 120 that extend between 60% to 80% of the thickness of the adjustment portion or strap 104, e.g., 2 mm tooth length for a 2.75 mm thick strap, beyond the base portion may be particularly well-suited for use with adjustment portions or straps 104 that have blind openings or holes, as teeth 120 of such lengths may provide secure engagement with the adjustment portions or straps 104 while still allowing for the minimum thickness of the adjustment portions or straps 104 in the areas of the blind openings to be kept at levels that provide useful mechanical reinforcement of the adjustment portions or straps 104.

In some implementations, the tooth 120 may be separated from the closest opposing surface of the transverse segment 116 by a gap X when viewed along a direction parallel to the third direction 136. The gap X may be between one and two times the thickness of the adjustment portion or strap 104 that is threaded through the loop portion 114, such that the adjustment portion or strap 104 may be pulled through the loop portion 114 without necessarily catching on the tooth 120 when the adjustment portion 104 is in at least some angular orientations with respect to the tangless buckle 110. For example, for an adjustment portion or strap 104 that is ~2.75 mm thick, the gap X may be between 2.75 mm and 5.5 mm, e.g., approximately 2.85 mm. There may also be a gap Y that exists between the base portion 112 and the closest opposing surface of the transverse segment 116 when viewed along a direction perpendicular to the tooth axis 138. The gap Y may be between ±10% of the thickness of the thickness of the adjustment portion or strap 104. It is to be understood that the ranges and dimensional values discussed above, as well ranges and values discussed elsewhere in this application, may vary from the example ranges provided depending on, for example, the material used in the bands, which may vary in terms of elasticity, stiffness, hardness or durometer values, etc., and other characteristics of the bands, e.g., surface texture or patterning. Accordingly, implementations that function in a manner similar to the implementations that are described herein but that may have features that fall outside of various ranges or values discussed herein may still be considered to be within the scope of this disclosure.

The transverse segment 116 may have an interior surface 156 and an exterior surface 158, and the base portion 112 may also have an interior surface 152 and an exterior surface 154. In some implementations, one or both of the interior and exterior surfaces 152 and 154, respectively, of the base portion 112 may be within ±10° of the first direction 132, e.g., there may be a smooth transition between the base portion 112 and the first end 168. In some other or additional implementations, the interior surface and/or exterior surface 156 and 158, respectively, of the transverse segment 116 may be within ±30° of the first direction 132, such that the adjustment portion or strap 104 lies flush or nearly flush against the interior surface 156 of the transverse segment 116 when the adjustment portion or strap 104 is straight and the tooth 120 is inserted into one of the openings in the adjustment portion or strap 104, e.g., such that a tooth contact surface 148 bottoms out in the opening or such that the interior surface of the adjustment portion or strap 104 rests against the base portion 112.

Figure 7:
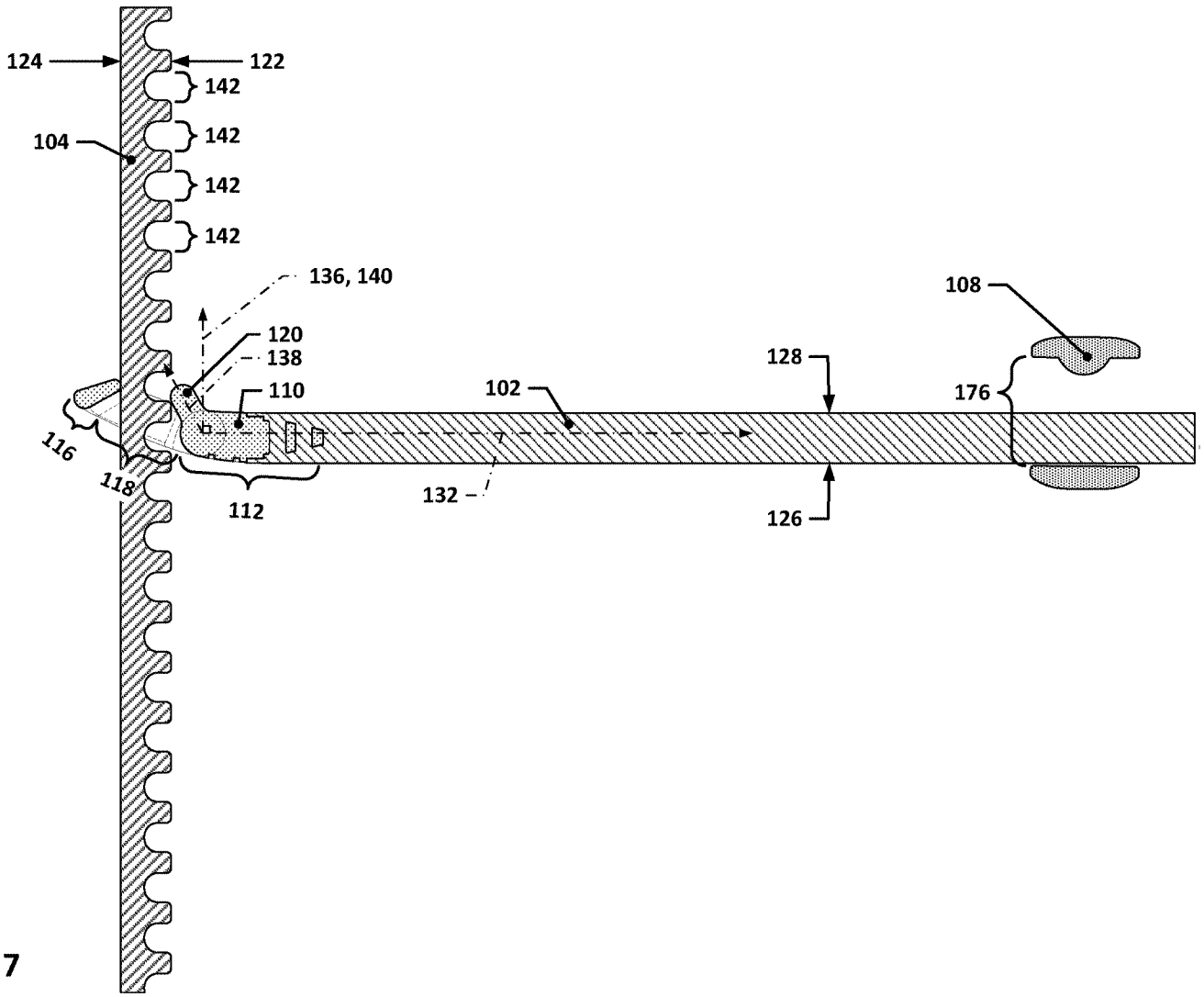
FIG. 7 depicts a side section view of the example tangless buckle of the wearable fitness tracker of FIG. 1 with an example adjustment strap or portion inserted through the tangless buckle.

FIG. 7 depicts a side section view of the example tangless buckle of the wearable fitness tracker of FIG. 1 with an example adjustment strap or portion inserted through the tangless buckle. As can be seen, the adjustment portion or strap 104 includes a plurality of openings 142, which are, in this example, blind holes—although, in other implementations, the openings 142 may extend all the way through the buckle portion or strap 104. The adjustment portion or strap 104 has an exterior surface 124 and an interior surface 122; as used herein, the terms "exterior surface" and "interior surface," unless indicated otherwise, refer, respectively, to surfaces that face away from a person's wrist and surfaces that face towards a person's wrist when the wristband is worn. As can be seen from FIG. 7, the adjustment portion or strap 104 may fit within the gap X when the adjustment portion or strap 104 is generally perpendicular to the first direction 132.

Figure 11:
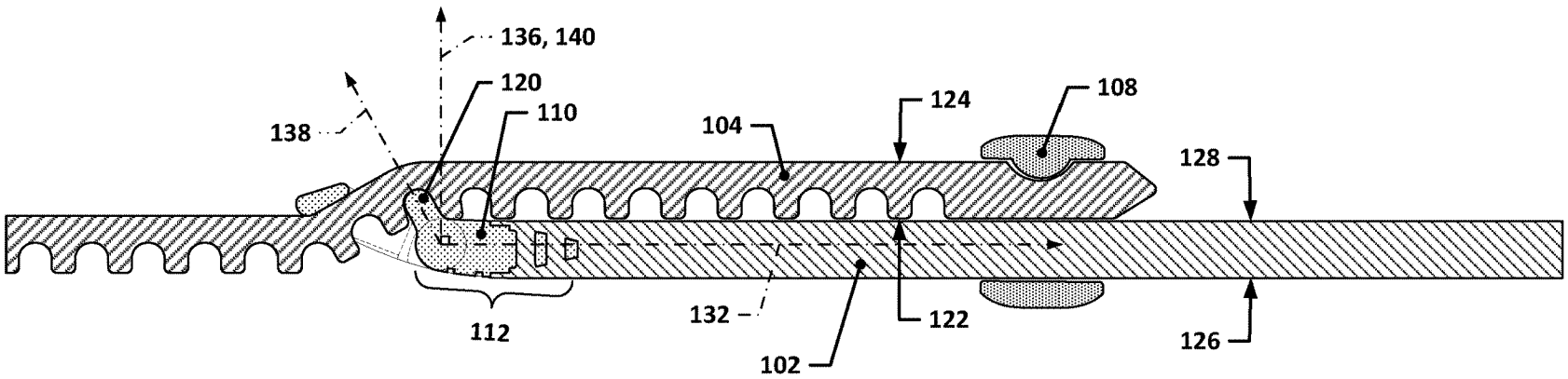
FIG. 11 depicts a side section view of the example tangless buckle of FIG. 10 with the example adjustment strap or portion fully fastened.

Also shown in FIG. 7 is the keeper 108, which, in this example, has an aperture 176 that is sized wider than the widths of the buckle portion or strap 102 and the adjustment portion or strap 104 and higher than the thickness of the adjustment portion or strap 104 and the buckle portion or strap 102. In some implementations, these dimensions may be slightly smaller such that the keeper 108 must flex or expand somewhat in order to pass the band portions or straps through the keeper 108, which may allow the keeper 108 to be kept in position on the band portions through friction. In the depicted example, the keeper 108 has a bump on an inner surface that may nestle into a corresponding recess on the adjustment portion or strap 104, thereby acting to keep the keeper 108 in place when used to retain the end of the adjustment strap 104, as can be seen in FIG. 11.

Figure 8:
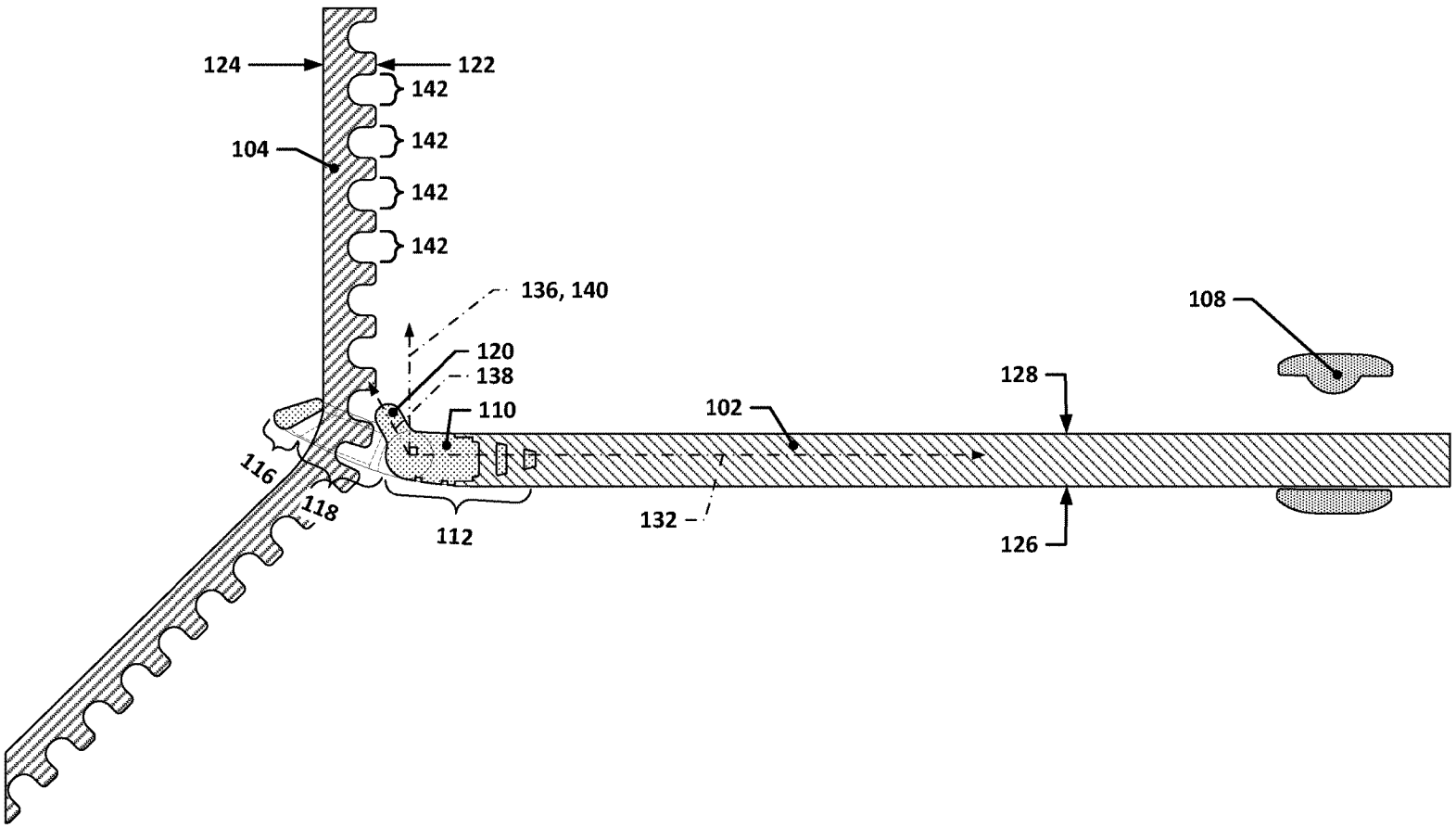
FIG. 8 depicts a side section view of the example tangless buckle of FIG. 7 with the example adjustment strap or portion inserted through the tangless buckle and partially tensioned.

FIG. 8 depicts a side section view of the example tangless buckle of FIG. 7 with the example adjustment strap or portion inserted through the tangless buckle and partially tensioned. In FIG. 8, the straps have been cinched down somewhat, such that the adjustment portion or strap 104 bends around the transverse segment 116 as it is pulled through the loop portion 114.

Figure 9:
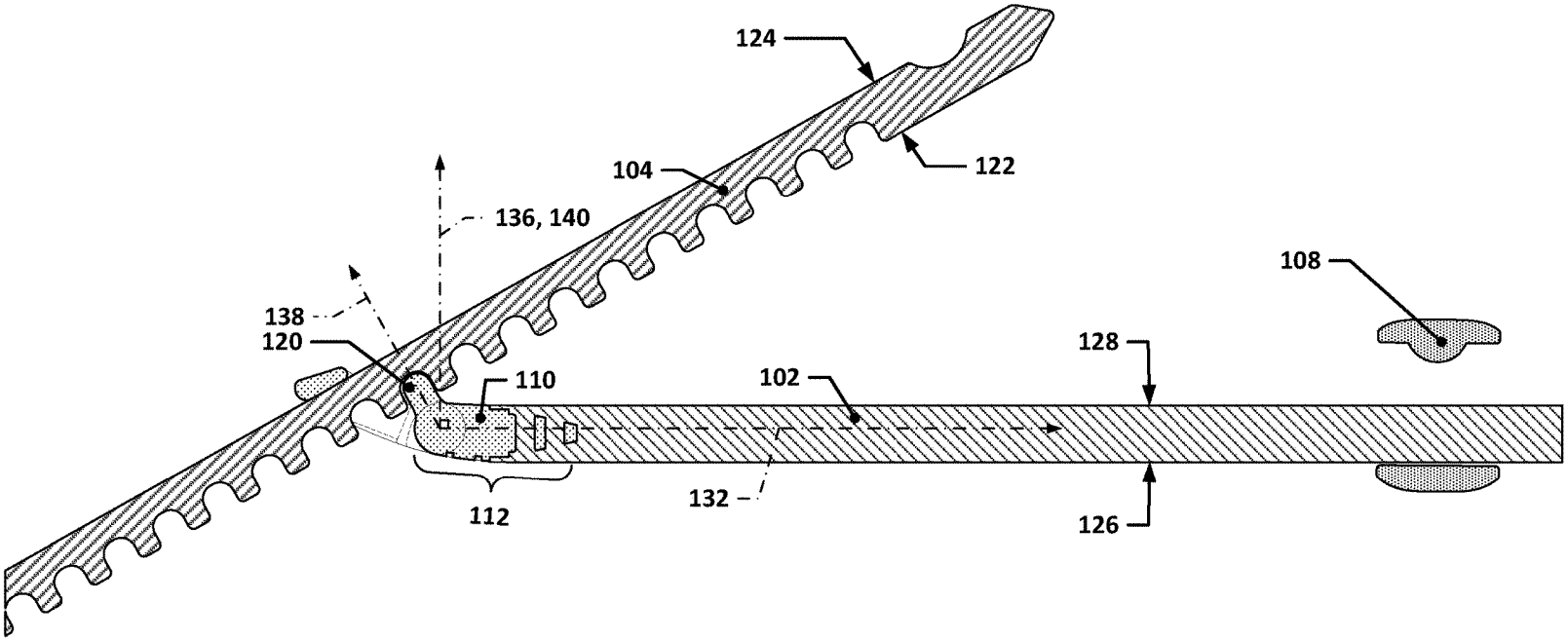
FIG. 9 depicts a side section view of the example tangless buckle of FIG. 8 with the example adjustment strap or portion inserted through the tangless buckle and engaged with the tooth.

FIG. 9 depicts a side section view of the example tangless buckle of FIG. 8 with the example adjustment strap or portion inserted through the tangless buckle and engaged with the tooth. As can be seen from FIG. 9, an opening 142 in the adjustment portion or strap 104 has been lowered over the tooth 120, which thereby prevents the adjustment strap 104 from being pulled back out through the loop portion 114. In this example, the exterior surface 124 of the adjustment portion or strap 104 rests against the interior surface 156 of the transverse segment 116. When the adjustment portion or strap 104 is cinched and then released, the natural flexing of the adjustment portion or strap 104 may cause the interior surface 122 of the adjustment portion or strap 104 to press against the tooth 120, which may then cause the tooth 120 to pass into one of the openings 142.

In some implementations, the tooth axis 138 may be nominally perpendicular to the longitudinal center axis of the adjustment portion or strap 104 in the region where the adjustment portion or strap 104 passes through the tangless buckle 110 when the adjustment portion or strap 104 is viewed in an undeflected or unflexed state and the exterior surface 124 of the adjustment portion 104 is in contact with the interior surface 156 of the transverse segment 116 and the interior surface 122 of the adjustment portion or strap 104 is in contact with the base portion 112 or the tooth contact surface 148 of the tooth 120 is in contact with the bottom of one of the openings 142 (assuming that the openings 142 are blind openings). Such an orientation of the tooth axis 138 with respect to the adjustment portion 104 may provide for enhanced interlocking interaction between the adjustment portion or strap 104 and the tangless buckle 110, thereby making the strap fastening more secure.

Figure 10:
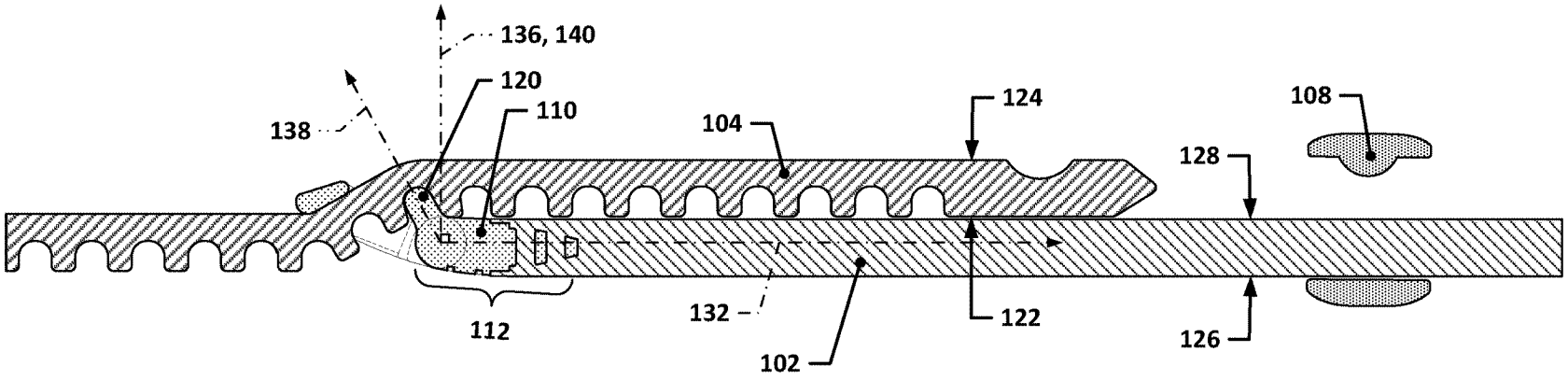
FIG. 10 depicts a side section view of the example tangless buckle of FIG. 9 with the example adjustment strap or portion positioned in the fastened position but without the keeper adjusted.

FIG. 10 depicts a side section view of the example tangless buckle of FIG. 9 with the example adjustment strap or portion positioned in the fastened position but without the keeper adjusted. As is evident, the adjustment portion or strap 104 may flex as it passes through the loop portion 114 and is held against the buckle portion or strap 102. FIG. 11 depicts a side section view of the example tangless buckle of FIG. 10 with the example adjustment strap or portion fully fastened. The keeper 108 has been moved to as to hold the end of the adjustment portion or strap 104 against the buckle portion or strap 102. This is the configuration shown in FIG. 3.

Figure 12:
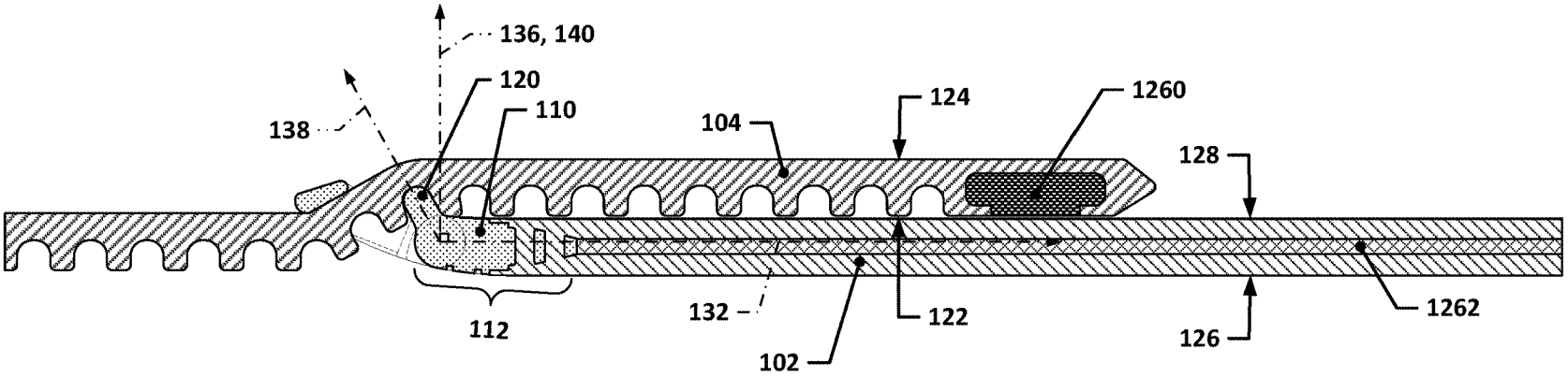
FIG. 12 depicts a side section view of another example tangless buckle in the fully fastened state, but using a magnetic keeper system instead of a mechanical keeper.

FIG. 12 depicts a side section view of another example tangless buckle in the fully fastened state, but using a magnetic keeper system instead of a mechanical keeper. In the implementation of FIG. 12, a magnet 1260, such as a rare-earth magnet, may be embedded within the end of the adjustment portion or strap 104. The buckle portion or strap 102 may have a flexible metal layer 1262 embedded within it; the flexible metal layer 1262 may be made of a ferrous material such that the magnet 1260 is attracted to the flexible metal layer 1262. Thus, once the straps are fastened together, the end of the adjustment portion or strap 104 may be pressed against the buckle portion or strap 102, where the magnet 160 may force the end of the adjustment portion or strap 104 against the buckle portion or strap 102 with the flexible metal layer, thereby acting much like the keeper 108. The flexible metal layer 162 may, for example, be a perforated, thin metal strip or a braided or woven metal strap. In some implementations, the buckle portion or strap 102 itself may be made from a material that is magnetic, e.g., a flexible polyurethane matrix with ferrous particles embedded within it.

Figure 13:
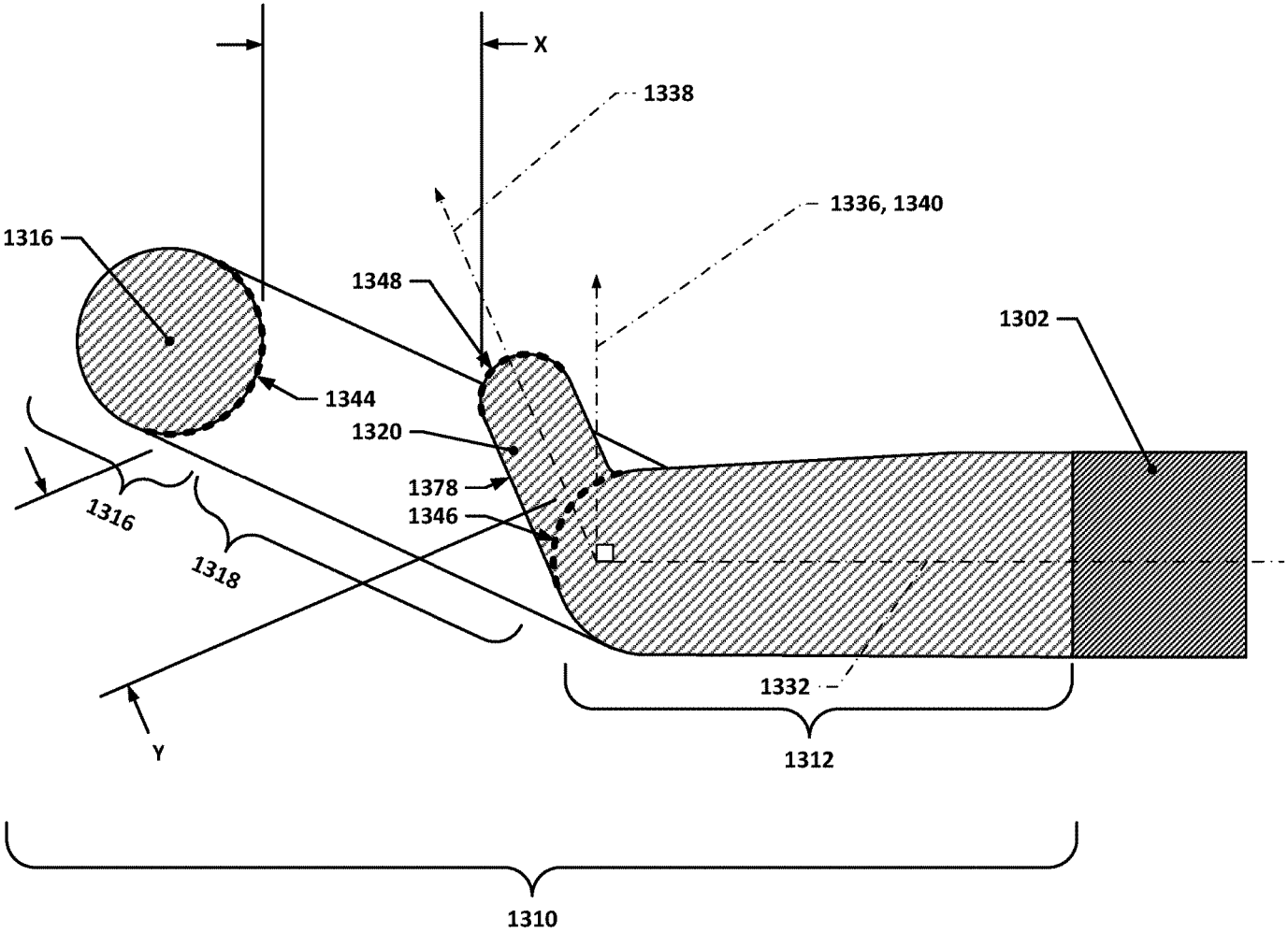
FIG. 13 depicts a side section view of another example tangless buckle.

FIG. 13 depicts a side section view of another example tangless buckle. In FIG. 13, a tangless buckle 1310 is depicted that has a transverse segment 1316 that is circular in cross-section (as opposed to the transverse segment 116, which was somewhat elongate in shape). The circular cross-section may distribute contact loads on the strap that is fed through the buckle across a larger area, thereby reducing any stress risers that may occur when the strap is flexed or bent around the transverse segment, such as is depicted in FIG. 8 with respect to the earlier-discussed implementation. This may increase the lifespan of the straps and make it easier to latch the strap and buckle. The circular cross-section transverse segment may also engage with or contact the adjustment strap across a contact patch that remains relatively constant in area during tightening or loosening of the buckle/adjustment strap. This results in friction loading between the transverse segment and the adjustment strap that remains relatively constant, providing a more consistent amount of force feedback to the user when the user is tightening the straps. Two side segments 1318 join the transverse segment 1316 to a base portion 1312 of the tangless buckle 1310. The tangless buckle 1310 is located at a first end of a buckle portion or strap 1302 (only the first end of the buckle portion or strap 1302 is shown, and the tangless buckle 1310 may be affixed to the buckle portion or strap 1302 in a manner similar to how the tangless buckle 110 is affixed to the buckle portion or strap 102).

The buckle portion or strap 1302 may extend away from the tangless buckle 1310 along a first direction 1332; the transverse segment 1316 may extend along a second direction that is perpendicular to the cross-sectional plane of FIG. 13. The tooth 1320 may extend along a tooth axis 1338, which may be within ±45° of an axis 1340 that extends along a third direction 1336 that is perpendicular to both the first direction 1332 and the second direction 1334. In the case of a negative angle, i.e., where the end of the tooth axis 1338 may be to the right of the axis 1340 in FIG. 13 rather than to the left of the axis 1340, the tooth 1320 may not only act to restrain the strap that is fed through the buckle, but the angle of the tooth 1320 may also act to pull that strap flat against the base portion 1312 of the buckle, thereby preventing gaps between the strap and the base portion and the strap 1302.

The base portion 1312 may have a base portion contact surface 1346 which, in this example, is arcuate in shape, but which may have other profiles in other implementations. Similarly, the transverse segment 1316 may have an opposing transverse segment contact surface 1344. In some implementations with arcuate base portion contact surfaces 1346 and transverse segment contact surfaces 1344, both such surfaces may have the same radius of curvature, although in other such implementations, these radii may be different or even vary as a function of angle. In some implementations, an interior surface 1378 of the tooth 1320 may be tangent with the base portion contact surface 1346 (or an extension thereof) to allow for easier cinching of the strap—the tangent transition between the base portion contact surface 1346 and the tooth 1320 in such implementations may provide a smooth surface along which the adjustment strap (not yet shown) may slide during cinching.

Figure 14:
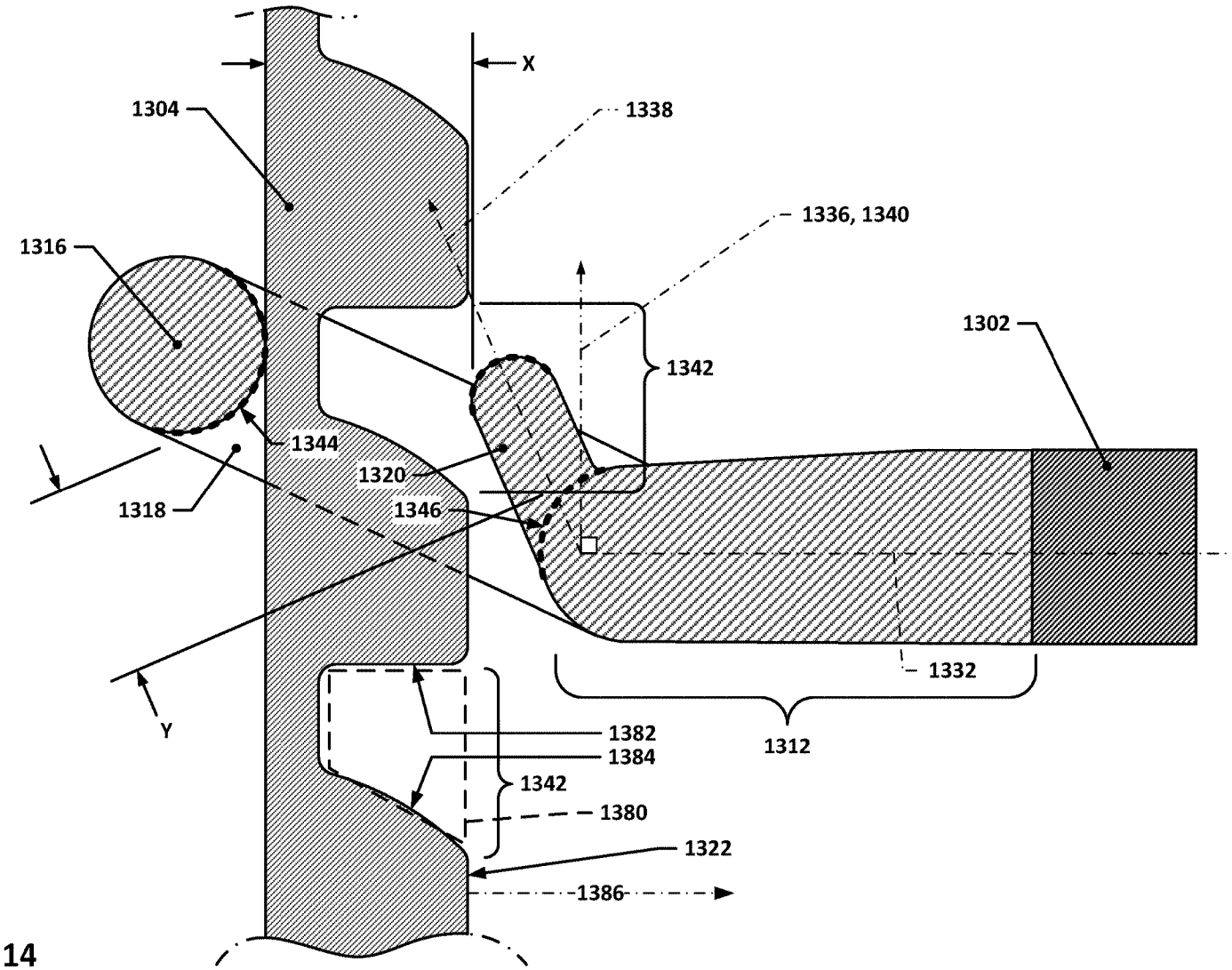
FIG. 14 depicts a side section view of the example tangless buckle of FIG. 13 with an adjustment strap inserted through the tangless buckle.

FIG. 14 depicts a side section view of the example tangless buckle of FIG. 13 with an adjustment strap inserted through the tangless buckle. As is evident, the adjustment portion or strap 1304 that is shown in FIG. 14 is somewhat different than the adjustment portion or strap 104 in that the openings 1342 have an almost trapezoidal shape, with one side surface of the openings 1342 curving away from the other; other similar implementations may simply use a straight sloped wall in place of a curved wall. For example, the lowermost opening 1342 is shown with a dashed outline of a trapezoidal cross-section 1380, which is at least partially defined by a first transverse surface 1382 and a second transverse surface 1384; the "top" and "bottom" of the trapezoid may be defined by the interior surface 1322 of the adjustment strap (or, more correctly, a reference surface that is coincident with the interior surface—there is, of course, no surface actually present since it is an opening) and the bottom of the opening or recess (in some implementations, the opening may pierce through the adjustment strap, in which case the bottom of the trapezoid may be coincident with the exterior surface of the adjustment strap). The second transverse surface may be sloped (when viewed from the perspective shown in FIG. 14) relative a direction 1386 that is perpendicular to the interior surface 1322 near the location of each opening to a greater extent than a corresponding slope (if any) of the first transverse surface. Such an implementation may allow for somewhat easier engagement of an opening 1342 with the tooth 1320 during fastening, but may require increased inter-opening spacing to accommodate the large openings 1342. As a result, such opening 1342 cross-sectional profiles may be easier to fasten but may not offer the granularity of adjustment that may be achieved with narrower profiles, e.g., the profiles of the openings 142.

Figure 15:
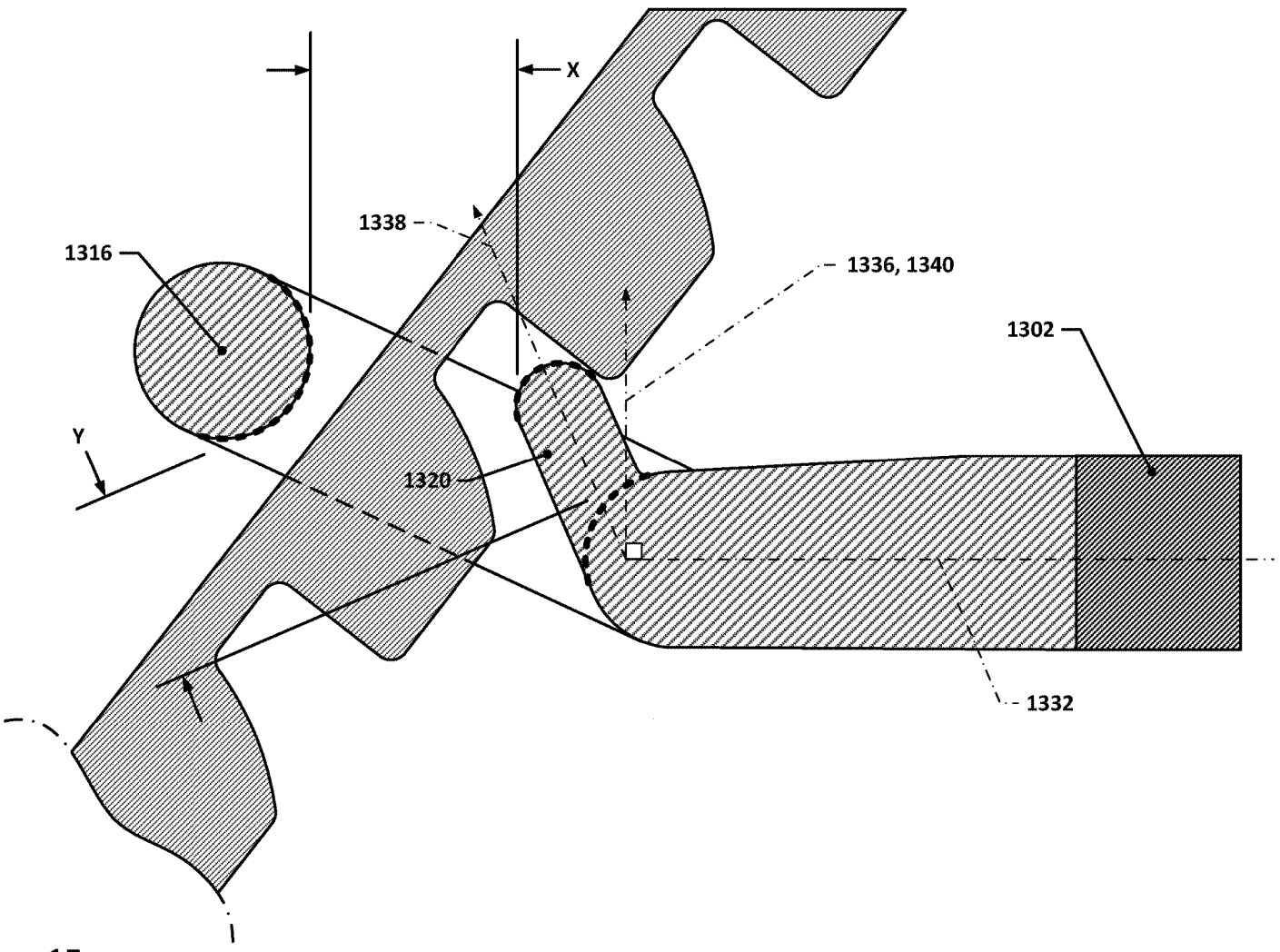
FIG. 15 depicts a side section view of the example tangless buckle of FIG. 14 with the adjustment strap rotated at an angle so that the tooth has started to pass into an opening on the adjustment strap.
Figure 16:
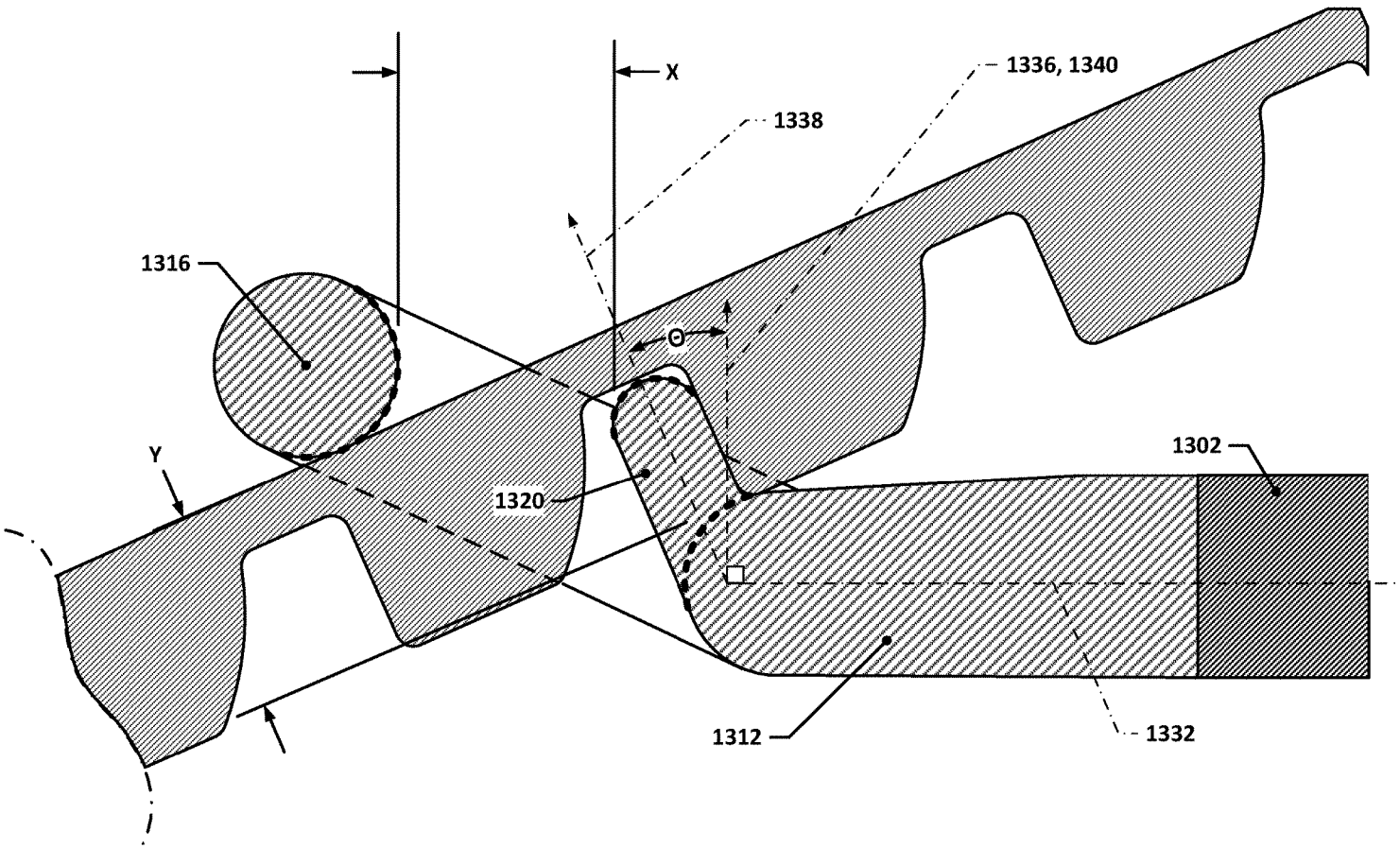
FIG. 16 depicts a side section view of the example tangless buckle of FIG. 15 with the adjustment strap fully engaged with the tooth.
Figure 19:
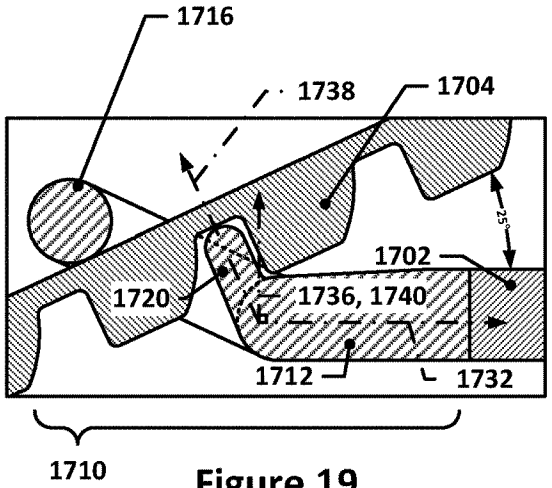
FIGS. 17 through 22 depict side section views of example tangless buckles similar to that of FIG. 13, but with different tooth angles and relative positioning between the base portion and the transverse segment of each of the tangless buckles
Figure 18:
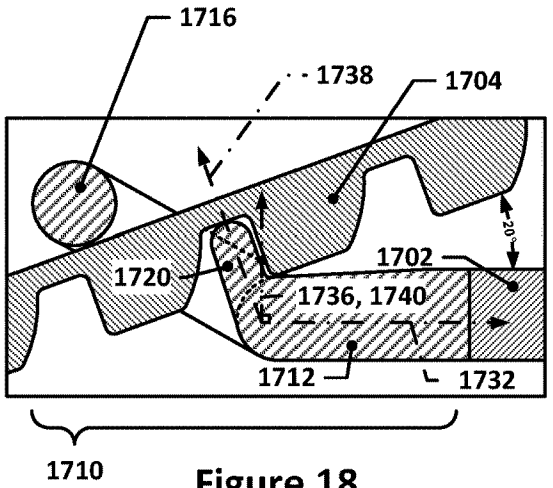
Figure 17:
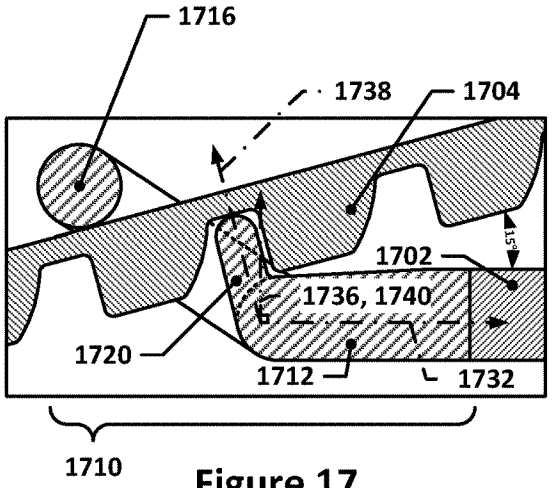
Figure 22:
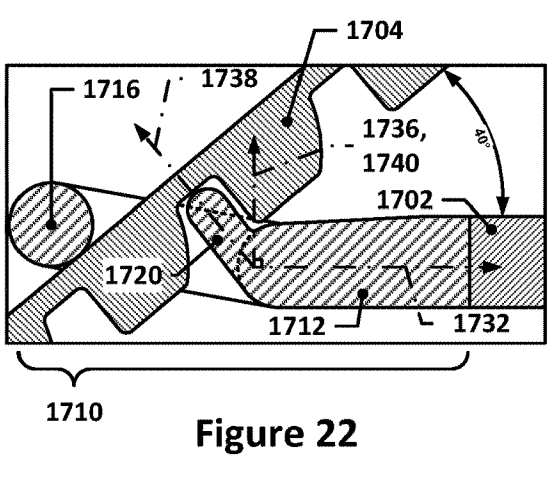
Figure 21:
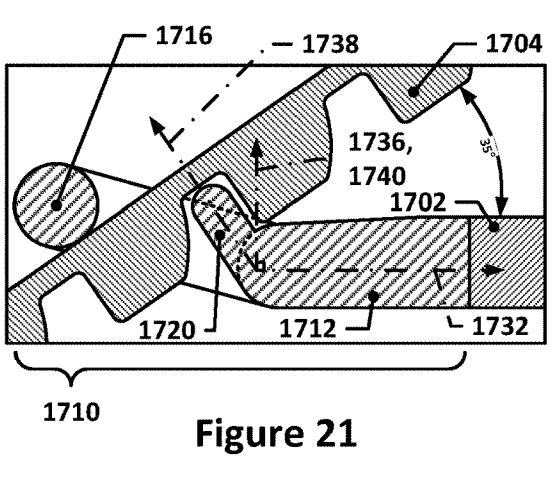
Figure 20:
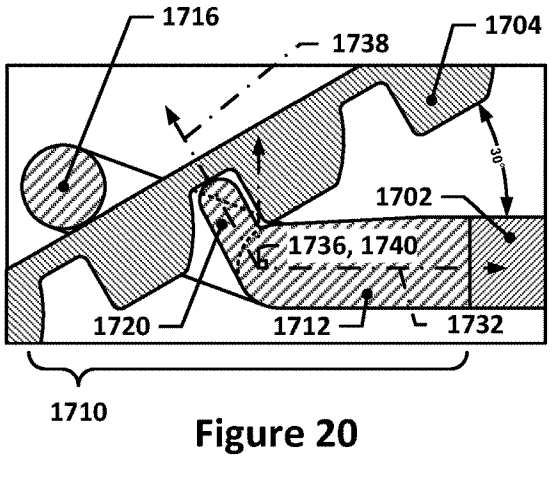

FIG. 15 depicts a side section view of the example tangless buckle of FIG. 14 with the adjustment strap rotated at an angle so that the tooth has started to pass into an opening on the adjustment strap. FIG. 16 depicts a side section view of the example tangless buckle of FIG. 15 with the adjustment strap fully engaged with the tooth. No figure is provided showing the adjustment portion or strap 1304 and the buckle portion or strap 1302 in the fully closed position as such a configuration would be similar to that shown for the implementation of FIGS. 4 through 12.

FIGS. 17 through 22 depict side section views of example tangless buckles similar to that of FIG. 13, but with different tooth angles and relative positioning between the base portion and the transverse segment of each of the tangless buckles. In each of FIGS. 17 through 22, a tangless buckle 1710 is depicted; the tangless buckle 1710 has a base portion 1712 that is connected with a buckle portion or strap 1702, which extends away from the base portion 1712 along a first direction 1732. The base portion 1712 may be connected with a transverse segment 1716 by two side segments (not labeled); the transverse segment 1716 may extend along an axis (not labeled) that is perpendicular to the cross-sectional planes of FIGS. 17 through 22, i.e., along a second direction that is perpendicular to the first direction 1732. A tooth 1720 may extend away from the base portion 1712 along a tooth axis 1738, which may be at an angle with respect to an axis 1740 that extends along a third direction 1736. This angle, in FIGS. 17 through 22, is equivalent to the angle formed between the adjustment portion or strap 1704 and the buckle portion or strap 1702 in the location where the angular measurement is indicated in each Figure. This angle is 15° in FIG. 17, 20° in FIG. 18, 25° in FIG. 19, 30° in FIG. 20, 35° in FIG. 21, and 40° in FIG. 22. The adjustment portion or strap 1704 is positioned in each of FIGS. 17 through 22 such that the tooth 1720 is fully engaged with an opening (not labeled) in the adjustment portion or strap 1704 and such that the exterior surface (the uppermost surface) of the adjustment portion or strap 1704 is generally perpendicular to the tooth axis 1738 and touching the transverse segment 1716. As can be seen, as the angle between the tooth axis 1738 and the axis 1740 increases, the height of the tangless buckle 1710 along the third direction 1736 decreases, making the tangless buckle 1710 more and more low-profile. However, the angle that the adjustment portion or strap 1704 makes with the buckle portion or strap 1702 may correspondingly grow larger and larger, requiring that the free end of the adjustment portion or strap 1704 that is to be retained by the keeper, magnet, or other retention mechanism (not shown) must be flexed or bent through a larger angle in order to lie flat against the buckle portion or strap 1702. Generally speaking, the tooth axis of the tangless buckles discussed herein may be within ±45° of an axis that is perpendicular to the first direction/longitudinal center axis of the buckle portions or straps to which the tangless buckles are affixed.

Figure 24:
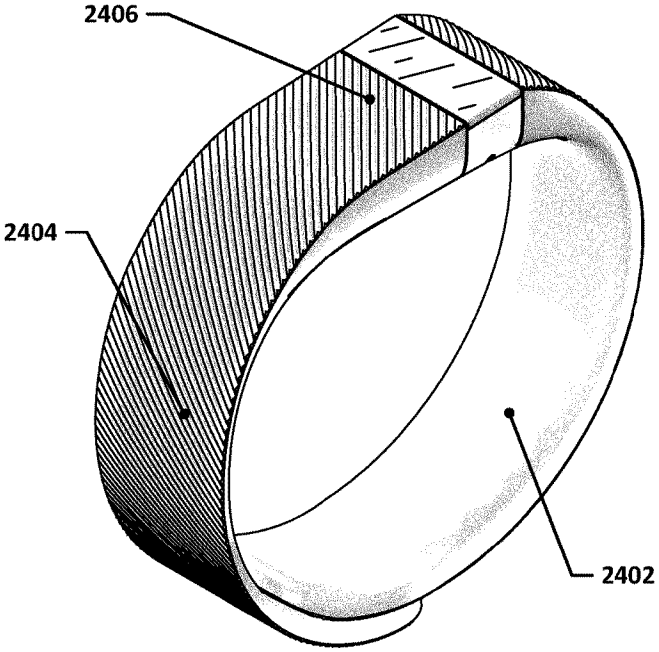
FIG. 24 depicts an example of straps that are integral with or permanently affixed to a watch or fitness tracker housing.
Figure 23:
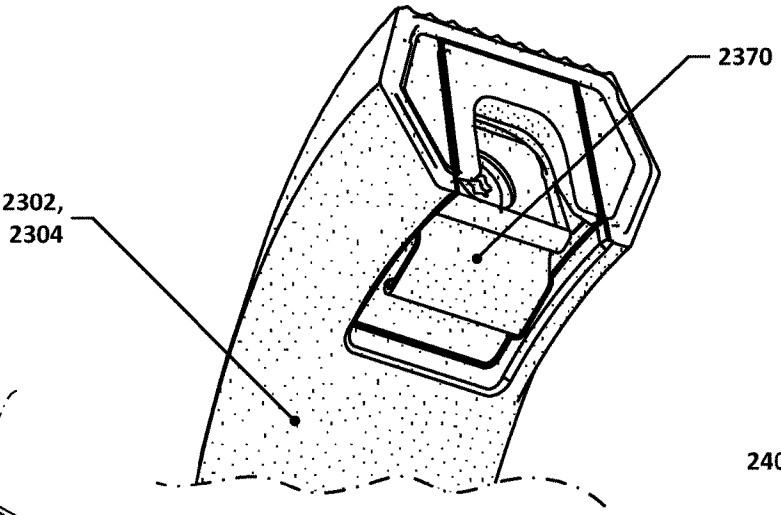
FIG. 23 depicts an example strap fastening mechanism for connecting a strap to a watch or fitness tracker housing.
Figure 23:
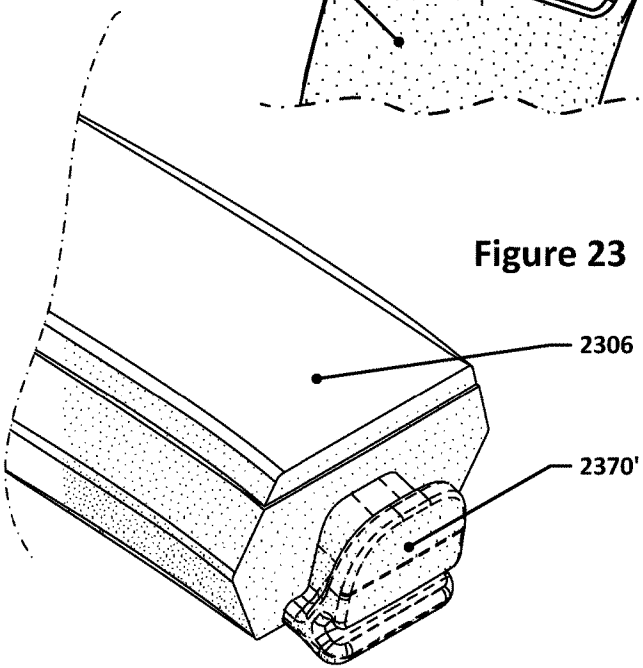

The tangless buckles discussed herein may be suitable for use with straps that are removable from a watch or tracker unit or that an integral to such a device. For example, FIG. 23 depicts an example strap fastening mechanism for connecting a strap to a watch or fitness tracker housing. In FIG. 23, an adjustment strap 2304 or a buckle strap 2302 may have a mechanical interface 2370, e.g., a sprung latch or other fastening system, that may be used to connect the straps to a tracker 2306 that may have a corresponding mating mechanical interface 2370'. FIG. 24 depicts an example of straps that are integral with or permanently affixed to a watch or fitness tracker housing. As can be see, the adjustment strap 2404 and the buckle strap 2402 are an integral part of the tracker 2406 (it is to be noted that this example does not feature any particular fastening mechanism in the straps at all, although the tangless buckle designs discussed herein may be implemented in such a design.

Various modifications to the implementations described in this disclosure may be readily apparent to those having ordinary skill in the art, and the generic principles defined herein may be applied to other implementations without departing from the spirit or scope of this disclosure. Thus, the disclosure is not intended to be limited to the implementations shown herein, but is to be accorded the widest scope consistent with the claims, the principles and the novel features disclosed herein.

As is readily apparent from the above discussion, certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

It will be understood that unless features in any of the particular described implementations are expressly identified as incompatible with one another or the surrounding context implies that they are mutually exclusive and not readily combinable in a complementary and/or supportive sense, the totality of this disclosure contemplates and envisions that specific features of those complementary implementations can be selectively combined to provide one or more comprehensive, but slightly different, technical solutions. It will therefore be further appreciated that the above description has been given by way of example only and that modifications in detail may be made within the scope of this disclosure.

What is claimed is:

1. A buckle for a strap, the buckle comprising:

a base portion;

a loop portion; and a tooth, wherein:

the base portion has a portion that is configured to be connected with an end of the strap in a non-rotating manner such that the strap extends away from the base portion along a first direction relative to the base portion when the end of the strap is connected with the base portion, the base portion, the loop portion, and the tooth are fixed with respect to one another, the loop portion includes:

a transverse segment that extends along a second direction perpendicular to the first direction, and opposing side segments, each opposing side segment connecting the transverse segment with the base portion, the tooth, when viewed along a direction perpendicular to the first direction, extends from the base portion and is positioned between the transverse segment and the portion of the base portion that is configured to be connected with the strap, and the tooth and the transverse segment are arranged such that there is a gap between the closest surfaces of the tooth and the transverse segment, when viewed from a direction perpendicular to the first direction, that is between one and two times the thickness of the end of the strap with which the base portion is configured to connect.

2. The buckle of claim 1, wherein the base portion, the loop portion, and the tooth are part of a single, contiguous piece.

3. The buckle of claim 1, wherein the tooth extends along a tooth axis that is within ±45° of an axis that is perpendicular to the first direction.

4. The buckle of claim 3, wherein:

the tooth has a nominally rectangular cross-section along the tooth axis, and the tooth has a rounded end.

5. The buckle of claim 1, wherein the transverse segment and the base portion, when viewed along a direction perpendicular to a direction along which the tooth extends from the base portion, are arranged such that there is a gap between the transverse segment and the base portion that is within ±10% of the thickness of the end of the strap.

6. The buckle of claim 1, wherein:

the base portion has an interior surface that is within ±10° of parallel with the first direction, and the base portion has an exterior surface that is within ±10° of parallel with the first direction.

7. The buckle of claim 6, wherein:

the transverse segment has an interior surface that is within ±30° of parallel with the first direction, and the transverse segment has an exterior surface that is within ±30° of parallel with the first direction.

8. Wrist straps comprising:

an adjustment portion;

a buckle portion; and a buckle, wherein:

the buckle includes a base portion, a loop portion, and a tooth;

the base portion is fixedly connected with a first end of the buckle portion such that the buckle portion extends away from the base portion along a first direction relative to the base portion and such that the buckle cannot pivot relative to the first end of the buckle portion;

the base portion, the loop portion, and the tooth are fixed with respect to one another;

an interior surface of the adjustment portion has a plurality of openings arranged in a linear array along a longitudinal center axis of the adjustment portion, each opening sized to receive the tooth, the loop portion includes:

a transverse segment that extends along a second direction perpendicular to the first direction, and opposing side segments, each opposing side segment connecting the transverse segment with the base portion;

the tooth, when viewed along a direction perpendicular to the first direction, extends from the base portion and is positioned between the transverse segment and the portion of the base portion that is fixedly connected with the first end of the buckle portion; and the tooth and the transverse segment are arranged such that there is a gap between the closest surfaces of the tooth and the transverse segment, when viewed from a direction perpendicular to the first direction, that is between one and two times a thickness of the adjustment portion in a direction perpendicular to the interior surface of the adjustment portion.

9. The wrist straps of claim 8, wherein the openings arranged in the linear array on the interior surface of the adjustment portion are blind recesses.

10. The wrist straps of claim 8, wherein the base portion, the loop portion, and the tooth are part of a single, contiguous piece.

11. The wrist straps of claim 8, wherein:

the adjustment portion has a first end with a first mechanical interface configured to connect the adjustment portion to a device housing, and a second end of the buckle portion opposite the first end of the buckle portion has a second mechanical interface configured to connect the buckle portion to the device housing.

12. The wrist straps of claim 8, wherein the adjustment portion and the buckle portion are sub-portions of a continuous, molded wristband.

13. The wrist straps of claim 8, wherein the tooth extends along a tooth axis that is within ±45° of an axis that is perpendicular to the first direction.

14. The wrist straps of claim 13, wherein:

the tooth has a nominally rectangular cross-section along the tooth axis, and the tooth has a rounded end.

15. The wrist straps of claim 8, wherein the transverse segment and the base portion, when viewed along a direction perpendicular to a direction along which the tooth extends from the base portion, are arranged such that there is a gap between the transverse segment and the base portion that is within ±10% of the thickness of the end of the strap.

16. The wrist straps of claim 8, wherein:

the base portion has an interior surface that is within ±10° of parallel with the first direction, and the base portion has an exterior surface that is within ±10° of parallel with the first direction.

17. The wrist straps of claim 16, wherein:

the transverse segment has an interior surface that is within ±30° of parallel with the first direction, and the transverse segment has an exterior surface that is within ±30° of parallel with the first direction.

18. The wrist straps of claim 8, further comprising a keeper, wherein:

the buckle portion has a first nominal width along a second direction within a first portion of the buckle portion adjacent to the buckle;

the buckle portion has a first nominal thickness along a third direction within the first portion;

the second direction and the third direction are both perpendicular to the first direction;

the first nominal width is larger than the first nominal thickness;

the keeper has an aperture through it that is:

larger in the second direction than the first nominal width, and larger in the third direction than the first nominal thickness plus a corresponding thickness of the adjustment portion; and the keeper encircles the buckle portion.

19. The wrist straps of claim 8, wherein:

at least one flexible metallic layer is embedded within the buckle portion, at least one magnet is located in the adjustment portion between the plurality of openings and an end of the adjustment portion that is inserted through the loop portion during fastening of the wrist straps, and the at least one magnet and the at least one flexible metallic layer are positioned such that the end of the adjustment portion that is inserted through the loop portion is held against the buckle portion by magnetic attraction between the at least one flexible metallic layer and the at least one magnet when the wrist straps are fastened.

* * * * *